US005769756A

United States Patent [19]

Parks

[11] Patent Number: 5,769,756

[45] Date of Patent: Jun. 23, 1998

[54] SPORTS TRAINING APPARATUS FOR VERTICAL JUMP AND BALANCE IMPROVEMENT

[76] Inventor: John Gerald Parks, 4526 N. Tenth St., Fresno, Calif. 93726

[21] Appl. No.: 755,418

[22] Filed: Nov. 22, 1996

[51] Int. Cl.[6] ..... A63B 4/00

[52] U.S. Cl. ..... 482/34; 482/36

[58] Field of Search ..... 422/32, 34, 35, 422/36

[56] References Cited

U.S. PATENT DOCUMENTS

| | | | |
|---|---|---|---|
| 1,747,721 | 2/1930 | Lowman | 482/32 |
| 3,580,568 | 5/1971 | Stone | 482/34 |
| 3,944,654 | 3/1976 | Moore | 482/34 |

OTHER PUBLICATIONS

Popular Mechanics, Jun. 1983, p. 98, Article on Play Structures.

*Primary Examiner*—Lynne A. Reichard

*Attorney, Agent, or Firm*—Richard A. Ryan

[57] ABSTRACT

An apparatus for use in training and conditioning athletes, particularly an athlete's jumping and balance abilities. The apparatus has jump stations with one or more platforms each that are spaced above the ground at various heights for exercises to improve an athlete's jumping ability. An athlete practices his or her jumping skills by jumping from the ground surface to the platforms. A center section interconnects two jump stations. The center section has a balance member that allows the athlete to practice his or her balance skills. The apparatus can be constructed of light weight materials so that it can be moved. The apparatus can also be manufactured for disassembly so that it can be easily moved to desired practice areas, such as a basketball court, and to facilitate storage. Use of the apparatus can be combined with development of the specific skills necessary for the athlete's desired sports training.

20 Claims, 4 Drawing Sheets

SPORTS TRAINING APPARATUS FOR VERTICAL JUMP AND BALANCE IMPROVEMENT

BACKGROUND OF THE INVENTION

1. Field of the Invention

The field of the present invention relates generally to sports training apparatuses for training and conditioning athletes. More specifically, the apparatus described herein relates to sports training equipment designed to facilitate the training and conditioning of an athlete's jumping and balance abilities, particularly those athletes who participate in sports requiring highly developed jumping and balance skills.

2. Background

Certain sports, such as basketball, volleyball, football, and track, as well as others, require athletes to develop and practice their jumping and balance skills in conjunction with the skills that are necessary for the specific sport. For instance, basketball requires the athlete to be able to jump in the air while maintaining his or her eye on the basket and shooting the ball towards the basket (i.e., the jump shot). Football and volleyball require the athlete to be able to jump towards a target while maintaining the ability to react when contact is made with the target. A number of track events (including the high jump, pole vault and long jump) require the athlete to be able to jump off the ground in a balanced and coordinated manner.

To improve an athlete's ability to jump, coaches engage in a variety of leg training and conditioning exercises designed to strengthen leg muscles and increase the motor reflexes of the legs. One of the most common ways to improve leg strength is through the use of weights and/or weight machines to increase an athlete's effective weight during training. With the increased effective weight, athletes typically perform exercises that involve repetitive raising and lowering of the weights (such as squats and leg presses). As the athlete utilizes the weight training his or her leg muscle strength should increase and, it is hoped, result in a corresponding increase in his or her ability to jump.

It is well known that sports training of any type is best accomplished by utilizing methods that closely simulate the activity that is sought to be improved. Unfortunately, use of the aforementioned methods of leg strength training to improve jumping ability lacks the necessary relationship to the actual jumping motion to fully benefit the athlete. Because squats and leg presses do not closely simulate jumping, the result can be a reduction in training efficiency or even a reduction in the very jumping skill sought to be improved.

In a jump, the athlete utilizes his or her muscles in a way that is fundamentally different than when doing squats or leg presses. Jumping requires the utilization of motor reflexes to quickly go from a standing or squatting position to an extended leg position. In addition, jumping requires full extension of the various muscles in the legs, something not required when doing squats or leg presses. Failure to properly exercise the motor reflexes necessary to accomplish a jump can result in lower vertical jumps, even though the athlete has had an increase in overall leg strength.

To properly exercise the legs to develop and maintain quick motor reflexes, the athlete should routinely practice the actual jumping motion at or near the speeds that will be required of him or her during the performance of the sport for which they train. Ideally, the athlete should be able to progress, both during a single exercise session and over time, from lower, relatively easy jumps to jumps requiring significantly more effort. The present invention allows the athlete to exercise the muscles and practice the techniques utilized in jumping while performing tasks related to his or her sport.

SUMMARY OF THE INVENTION

The sports training apparatus in accordance with the present invention solves the problems associated with the weight training procedures described above and with other equipment and procedures to train athletes to jump. That is to say, the present invention provides a sports training apparatus that is portable, easy to use and effective for training and conditioning the jumping ability of an athlete.

The sports training apparatus of the present invention can be constructed of any light weight, strong and substantially inelastic material, such as wood, any number of generally available synthetic plastics or any number of other materials that provide the characteristics suitable for accomplishing the objectives described herein. The material chosen should be of sufficient strength to avoid damage from the effects of adult-sized athletes jumping or walking on the apparatus, but light weight enough to allow the apparatus to be moved in and out of practice areas as desired by the coach or athlete.

The sports training apparatus comprises a center section interconnecting two jump units, a first jump unit and a second jump unit, each having at least one jump step. Along the top of the center section is a top face of suitable width to allow an athlete to safely walk along its length and of suitable strength to support the athlete's weight. The jump steps define one or more substantially planar platforms spaced above and parallel to the ground surface. The top jump step could be at the same height as the top of the center section. The center section can be a generally rectilinear balance member that, depending on its length, utilizes one or more support members to avoid bending or sagging. Alternatively, the center section can be a solid or semi-solid wall-like configuration to support an athlete's use. A long center section may necessitate bracing to prevent lateral movement during use. The apparatus can include the ability to have an inclined center section for further exercise capability.

In the preferred embodiment, the sports training apparatus of the present invention has interior jump units in addition to the jump units at each end of the center section. One configuration is to utilize four jump units, the first and second jump units at the ends of the center section and two interior jump units evenly spaced along the length of the center section. For instance, if a twelve foot long center section is utilized, there could be a jump unit at four feet from each end of the center section (and from the jump units at the ends of the center section). The jump units at the ends of the center section could be positioned such that the vertical center line of the center section intersects the vertical center line of the side face of each jump unit, resulting in the center section extending perpendicular from one jump unit toward the jump unit at the opposite end of the center section. Any interior jump unit placed along the length of the center section would be set such that its side face abuts against a side of the center section, resulting in the interior jump unit being in a 90° relationship with the first and second jump units.

On any jump unit having more than one jump step, the jump steps should be at different heights to allow varying levels of jumping practice. For instance, if three jump steps are utilized, the first jump step can be 12 inches high, the second 24 inches high and the third 36 inches high (or any other configuration). As between jump units, the height of the jump steps can vary from one jump unit to another to further increase the variety of jump heights available for practice. To encourage the use of the jump steps in a non-incremental manner, the jump steps could be offset from each other to further facilitate jumping to the higher heights.

To facilitate the portability of the sports training apparatus of the present invention, the center section should be capable of collapsing or folding to a smaller, more easily carried length or be manufactured in relatively small lengths that connect to form the desired length. The first and second jump units should securely connect to the center section in a manner that does not interfere with the athlete's use of the apparatus (i.e., jumping on the jump unit or moving along the top of the balance member), but which allows easy disconnecting when portability is desired. Any interior jump units should also securely connect to the center section in a manner that does not interfere with walking along the top of the center section. As with the first and second jump units, an athlete or coach should be able to easily disconnect the interior jump unit from the center section when they desire portability. If desired, the jump units can be manufactured such that the jump steps can be separated from each other for additional portability and then reconnected for use.

In use, the athlete or coach transports the components of the sports training apparatus of the present invention to the practice area (i.e., a basketball court) and assembles the components into the apparatus as described. Once the apparatus is assembled and properly positioned, the athlete can work on conditioning by practice jumping to the various levels created by the jump steps and work on balance by walking across the balance member. As the athlete exercises, the continued jumping will condition the muscles used in jumping. His or her balance capabilities will be enhanced by walking along the center section under fatigue conditions. After conditioning, the athlete can work on skill development. Depending on the sport for which he or she trains, the athlete can combine various aspects of the sport with the sports training apparatus of the present invention. For instance, the basketball player can practice jumping to various levels on the jump units while practicing the jump shot or passing. Upon completion of the practice session, the sports training apparatus can be disassembled and stored.

Accordingly, the primary objective of the present invention is to provide a durable, lightweight and relatively inexpensive, yet effective, apparatus for improving an athlete's jumping and balance capabilities.

It is also an important objective of the present invention to provide a sports training apparatus capable of being easily disassembled, transported and stored.

Another important objective of the present invention is to provide a sports training apparatus comprising a center section of sufficient strength to support adult athletes that interconnects two jump units having one or more jump steps on each unit which are suitable for being jumped on by adult athletes.

Yet another important objective of the present invention is to provide a sports training apparatus suitable for use by more than one athlete at a time.

Yet another important objective of the present invention is to provide a sports training apparatus for use with various sports facilities and sporting equipment and which is suitable for exercising and conditioning athletes who participate in a wide variety of different sporting events.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best modes presently contemplated for carrying out the present invention.

DETAILED DESCRIPTION OF THE PREFERRED EMBODIMENTS

Figure 1:
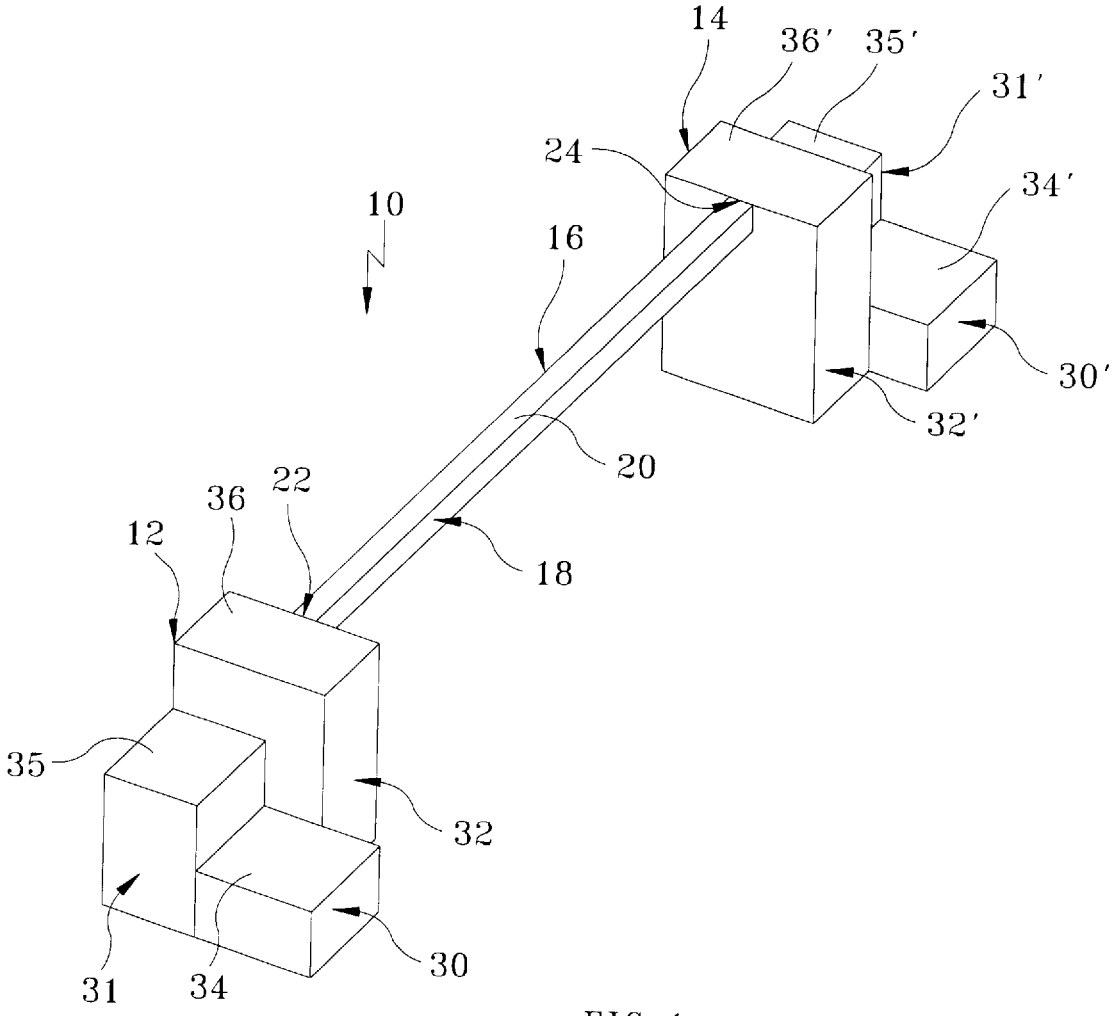
FIG. 1 is a perspective view of one embodiment of the sports training apparatus of the present invention showing the use of a non-supported generally rectilinear balance member.
Figure 2:
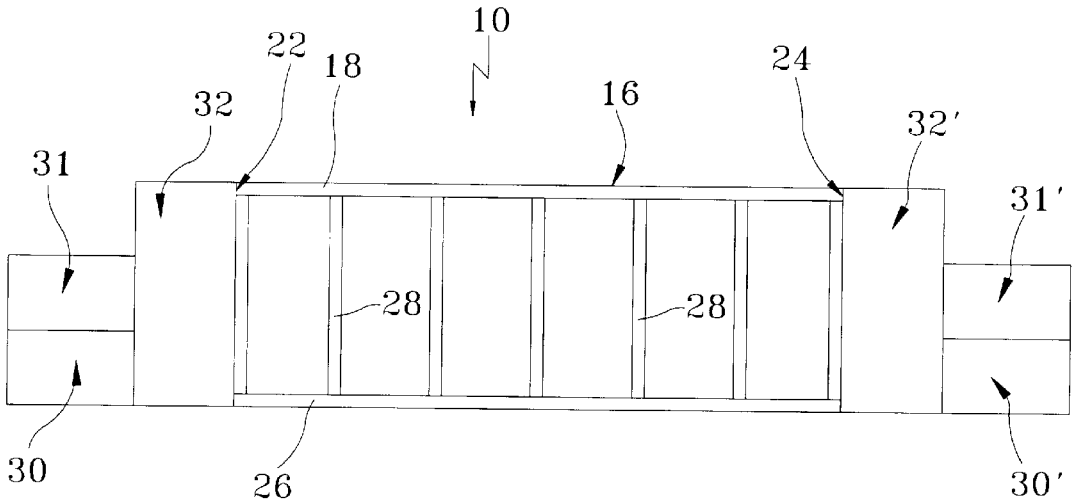
FIG. 2 is a side view of an embodiment of the sports training apparatus showing the use of support members.
Figure 3:
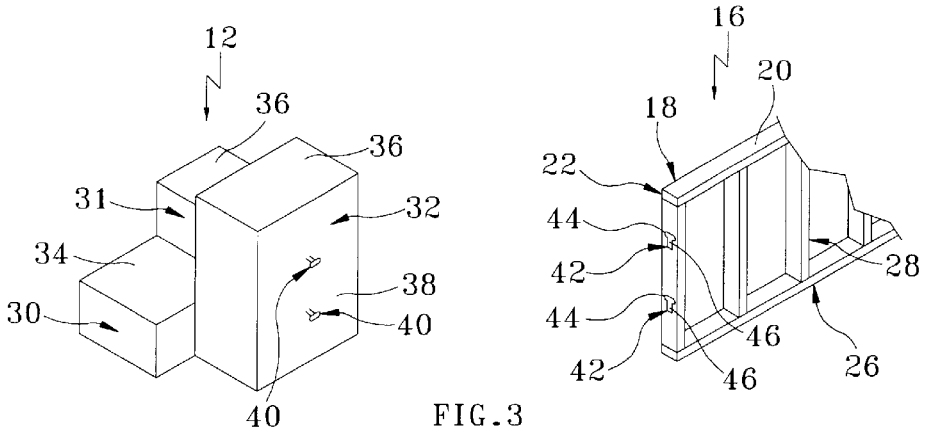
FIG. 3 is an exploded perspective view of the embodiment shown in FIG. 2, showing one method of removably connecting the side face of the first jump unit to the center section.

With reference to the figures where like elements have been given like numerical designations to facilitate understanding of the present invention, and particularly with reference to the embodiment of the present invention illustrated in FIGS. 1–3, the sports training apparatus is designated generally 10. The sports training apparatus 10 includes a first jump unit 12, a second jump unit 14 and a center section 16. The center section 16 has a generally rectilinear balance member 18 having a top face 20, a first end 22 and a second end 24. The length of center section 16 can be any length suitable for providing balance training for the sporting activity sought to be improved.

The first jump unit 12 comprises one or more jump steps 30, 31 and 32 defining generally planar platforms 34, 35 and 36 that are spaced above and substantially parallel to the ground surface. The second jump unit 14 comprises one or more jump steps 30', 31' and 32' defining generally planar platforms 34', 35' and 36' that are spaced above and substantially parallel to the ground surface. As shown in this embodiment, the sports training apparatus can utilize three jump steps, wherein jump steps 30 and 30' are lower than jump steps 31 and 31', which are lower than jump steps 32 and 32'. The height of jump steps 32 and 32' are shown substantially equal to the height of the top face 20 of the balance member 18 in center section 16. The number of jump steps, distance between jump steps and the total height of the highest jump steps 32 and 32', and center section 16 can be any amount suitable for the sport activity sought to be improved by the apparatus of the present invention. The dimensions of platforms 34, 35 and 36, and 34', 35' and 36' are shown as approximately equal, however, they can also be varied depending upon the training effect desired.

As shown in FIG. 2, depending on the length of center section 16 and the materials and dimensions utilized, the center section 16 may require the use of a base member 26 and one or more support members 28 interconnecting balance member 18 and base member 26 to provide support for balance member 18. As shown in FIG. 3, the center section 16 of this embodiment can removably attach to side face 38 of jump unit 12. Side face 38 of jump unit 12 could have one or more male connector elements 40 and center section 16 would have a corresponding number of female connector elements 42. In use, the male connector element 40 on the first jump unit 12 is placed inside the enlarged opening 44 of female connector element 42 on center section 16. The jump unit 12 is then slid down such that the male connector 40 locks into place behind the narrow portion 46 of female connector 42, thereby securely connecting the center section 16 to the jump unit 12 so that they will function as one unit when the athlete utilizes the sports training apparatus. The functional characteristics or relative positioning of the male and female components of the connectors can be reversed.

Figure 4:
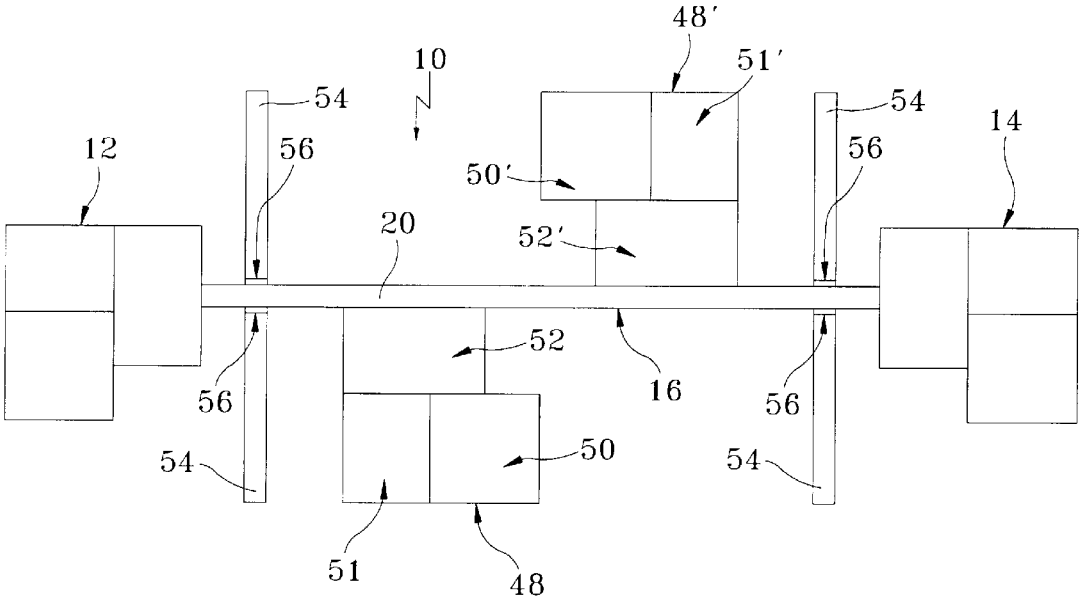
FIG. 4 is a top plan view of another embodiment of the sports training apparatus of the present invention showing the use of interior jump units and braces.
Figure 5:
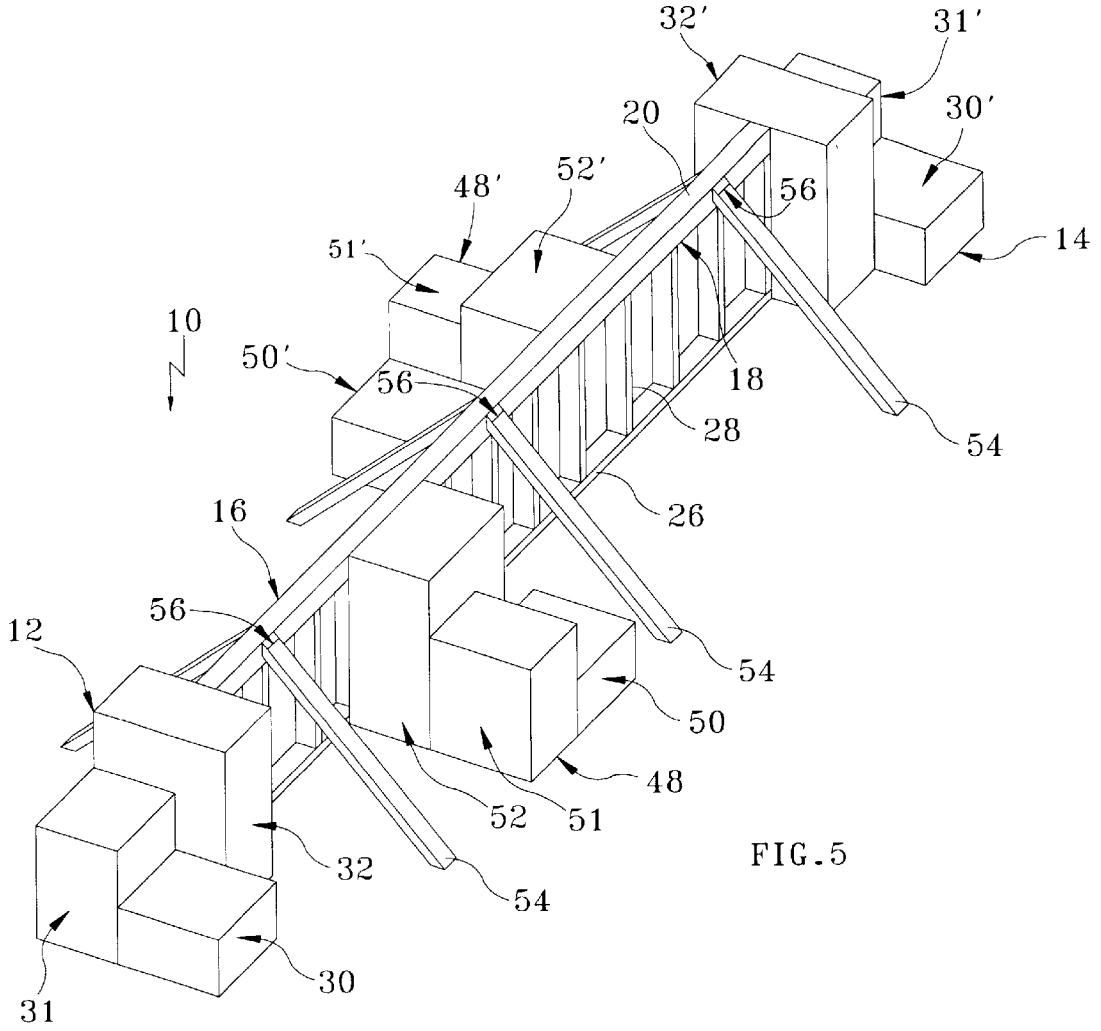
FIG. 5 is an perspective view of the embodiment of the sports training apparatus shown in FIG. 4.

As shown in FIGS. 4 and 5, the sports training apparatus of the present invention can incorporate one or more interior jump units 48 and 48' placed against center section 16 between first jump unit 12 and second jump unit 14. The interior jump units 48 and 48' allow more persons to utilize the sports training apparatus 10 at the same time and allows different positioning relative to the practice area in which it is being used (i.e., basketball court). The jump steps 50, 51 and 52, and 50', 51' and 52' of interior jump units 48 and 48', respectively, can be configured the same as the first jump unit 12 and the second jump unit 14, or they can be different to enable the coach or athlete to vary the exercise program.

As also shown in FIG. 4 and in FIG. 5, the sports training apparatus 10 can include one or more pair of opposing brace members 54 to provide lateral support to the sports training apparatus 10 when a long center section 16 is utilized. The brace members 54 should be able to lock in place and be of sufficient strength to prevent center section 16 from swaying or collapsing when an adult sized athlete is utilizing balance member 18 for training purposes. The brace members 54 could utilize a hinge 56 to foldably attach to center section 16 at a support member 28 or balance member 18. To facilitate portability and reduce storage space, brace members 54 can collapse against center section 16 or telescopically close when the sports training apparatus 10 is not in use.

Figure 6:
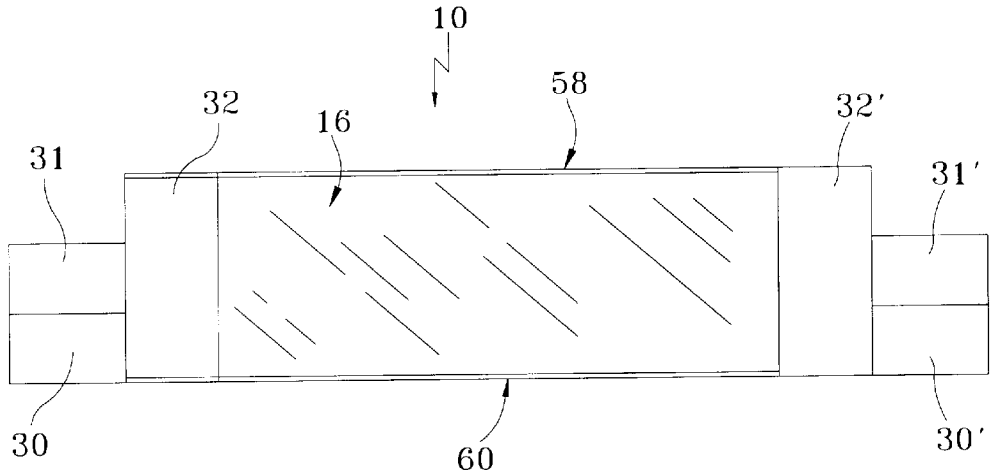
FIG. 6 is a side view of another embodiment of the present invention depicting the use of a solid or semi-solid one-piece center section.

Another embodiment of the sports training apparatus is illustrated in FIG. 6. This embodiment utilizes a solid or semi-solid, one-piece center section 16. The center section 16 in this embodiment could be I-shaped to provide a top surface 58 for the athlete to walk on and a substantially flat bottom surface 60 to support the apparatus 10 and the athlete. To facilitate transport and storage of this embodiment of the present invention, the center section 16 could be collapsible or manufactured in segments that are connected together for use.

While there is shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape, and use, all of which may be dependent upon the particular sport training desired.

What is claimed is:

1. A sports training apparatus for training athletes, comprising:

a first jump unit, said first jump unit having a first side face and one or more jump steps, said one or more jump steps defining one or more generally planar platforms spaced above and substantially parallel to the ground surface;

a second jump unit, said second jump unit having a second side face and one or more jump steps, said one or more jump steps defining one or more generally planar platforms spaced above and substantially parallel to the ground surface;

a center section, said center section having a first end, a second end and a generally rectilinear balance member, said balance member having a top face, said top face in substantially planar relationship with one of said one or more jump steps on said first jump unit and on said second jump unit;

first connecting means for releasably connecting said first end of said center section to said first jump unit; and second connecting means for releasably connecting said second end of said center section to said second jump unit.

2. The sports training apparatus according to claim 1, wherein said first jump unit has at least two jump steps, each of said jump steps comprising a generally planar platform, said platform on each of said lump steps being in a non-planar relationship to said platform on each other of said jump steps.

3. The sports training apparatus according to claim 2, wherein each of said jump steps further comprise a horizontal axis parallel to said rectilinear balance member, said horizontal axis of each of said jump steps in a non-linear relationship to said horizontal axis of each other said jump step.

4. The sports training apparatus according to claim 1, wherein both said first and said second jump units have at least two jump steps each, each of said jump steps comprising a generally planar platform, wherein said platform on each of said jump steps is in a non-planar relationship to said platform on each other of said jump steps.

5. The sports training apparatus according to claim 1, wherein said center section further comprises a base member and at least one support member interconnecting said balance member and said base member.

6. The sports training apparatus according to claim 1, wherein said center section further comprises a base member and a plurality of laterally spaced support members interconnecting said balance member and said base member.

7. The sports training apparatus according to claim 1, wherein said first connecting means is one or more female connector elements on said first end of said center section and one or more male connector elements on said first side face of said center section, said one or more male connector elements in functional alignment with said one or more female connector elements.

8. The sports training apparatus according to claim 1, wherein said second connecting means is one or more female connector elements on said second end of said center section and one or more male connector elements on said second side face of said second jump unit, said one or more male connector elements in functional alignment with said one or more female connector elements.

9. The sports training apparatus according to claim 1, wherein said center section is collapsible.

10. The sports training apparatus according to claim 1 which further comprises one or more interior jump units releasably attached to said center section, said one or more interior jump units having one or more jump steps defining one or more generally planar platforms.

11. A sports training apparatus for training athletes, comprising:

a first jump unit, said first jump unit having a first side face and one or more jump steps, said one or more jump steps defining one or more generally planar platforms;

a second jump unit, said second jump unit having a second side face and one or more jump steps, said one or more jump steps defining one or more generally planar platforms;

a center section interconnecting said first jump unit and said second jump unit, said center section having a first end, a second end and a generally rectilinear balance member, said balance member having a top face;

one or more brace members; and a hinge connecting each of said one or more brace members to said center section, said hinge suitable for locking each of said one or more brace members in a brace condition.

12. The sports training apparatus according to claim 11, wherein said first jump unit has at least two jump steps, each of said jump steps comprising a generally planar platform, wherein said platform on each of said jump steps is in a non-planar relationship to said platform on each other of said jump steps.

13. The sports training apparatus according to claim 11, wherein both said first and said second jump units have at least two jump steps each, each of said jump steps comprising a generally planar platform, wherein said platform on each of said jump steps is in a non-planar relationship to said platform on each other of said jump steps.

14. The sports training apparatus according to claim 11 further comprising connecting means for releasably connecting said first and second jump units to said center section.

15. The sports training apparatus according to claim 11 further comprising one or more interior jump units releasably attached to said center section, said one or more interior jump units having one or more jump steps defining one or more generally planar platforms.

16. The sports training apparatus according to claim 11, wherein said hinge allows said one or more brace members to be disconnected from said center section when the sports training apparatus is not in use or said one or more brace members are not needed.

17. A sports training apparatus for training athletes, comprising:

a first jump unit, said first jump unit having a first side face and one or more jump steps, said one or more jump steps defining one or more generally planar platforms;

a second jump unit, said second jump unit having a second side face and one or more jump steps, said one or more jump steps defining one or more generally planar platforms;

a center section interconnecting said first jump unit and said second jump unit, said center section having a first end, a second end and a generally rectilinear balance member, said balance member having a top face;

one or more brace members, said brace members comprised of telescoping tubular members; and brace connector means for connecting said one or more brace members to said center section.

18. The sports training apparatus according to claim 17 further comprising connecting means for releasably connecting said first and second jump units to said center section.

19. The sports training apparatus according to claim 17 further comprising one or more interior jump units releasably attached to said center section, said one or more interior jump units having one or more jump steps defining one or more generally planar platforms.

20. The sports training apparatus according to claim 17, wherein said brace connector means allows said one or more brace members to be disconnected from said center section when the sports training apparatus is not in use or said one or more brace members are not needed.

* * * * *